United States Patent [19]

Förster et al.

[11] 4,450,767

[45] May 29, 1984

[54] REMOTE CONTROL SYSTEM FOR INK ZONES IN PRINTING MACHINES

[75] Inventors: Karl-Heinz Förster, Dresden; Hans Johne, Radebeul; Helmut Schuck, Coswig; Ludwig Friedrich, Dresden, all of German Democratic Rep.

[73] Assignee: VEB Kombinat Polygraph "Werner Lamberz" Leipzig, Leipzig, German Democratic Rep.

[21] Appl. No.: 459,620

[22] Filed: Jan. 20, 1983

Related U.S. Application Data

[63] Continuation-in-part of Ser. No. 451,546, Dec. 21, 1982.

[51] Int. Cl.[3] ..... B41F 31/04

[52] U.S. Cl. ..... 101/365

[58] Field of Search ..... 101/365, 350, 366, 210, 101/206, 207, 208, 363, 349, 148, 248; 340/825.56, 825.05, 825.06; 318/396

[56] References Cited

U.S. PATENT DOCUMENTS

| | | | |
|---|---|---|---|
| 3,585,595 | 6/1971 | Slavin | 340/825.05 |
| 3,614,738 | 10/1971 | Slavin | 340/825.56 |
| 3,702,587 | 11/1972 | Lee | 101/207 |
| 3,746,957 | 7/1973 | Förster et al. | 318/696 |
| 3,747,524 | 7/1973 | Crum | 101/365 |
| 3,774,536 | 11/1973 | Raymond et al. | 101/207 |

FOREIGN PATENT DOCUMENTS

| | | | |
|---|---|---|---|
| 2024457 | 1/1980 | United Kingdom | 101/365 |

*Primary Examiner*—J. Reed Fisher
*Attorney, Agent, or Firm*—Michael J. Striker

[57] ABSTRACT

Disclosed is a control system for an ink blade of a printing machine provided with a series of key setting units each having a key position sensor and a key drive controlled by an adjusting device described in patent application Ser. No. 252,126. In order to achieve proper adjustment of marginal key setting units, there is provided a switching unit with a plurality of contacts assigned to respective key position measuring sensors and including additional switching contacts assigned to imaginary key position setting units adjoining the real setting units at each end of the ink zone. The additional marginal switching contacts are connected to the output of assigned sample-and-hold members which apply thereto the measured value from the extreme actual position sensors so that comparing differential transducer comparing the measured values of consecutive pairs of position sensors always produces a starting difference which does not exceed a predetermined limit value.

2 Claims, 2 Drawing Figures

REMOTE CONTROL SYSTEM FOR INK ZONES IN PRINTING MACHINES

CROSS-REFERENCE TO RELATED APPLICATIONS

This application is a continuation-in-part application of our copending application Ser. No. 451,546, filed on Dec. 21, 1982 and entitled CONTROL DEVICE FOR THE REMOTE INK ZONE ADJUSTMENT IN PRINTING PRESSES.

Reference is had to the allowed application Ser. No. 252,126, filed Apr. 8, 1981 now U.S. Pat. No. 4,369,706, and assigned to the same assignee, the entire disclosure of which is incorporated herein.

BACKGROUND OF THE INVENTION

In the above-referenced application a control device for remote adjustments of ink zones in printing presses has been devised, containing a continuous ink blade provided with an adjusting system composed of a series of setting keys each being adjustable by a motor drive and provided with a key position sensor. The individual position sensors being connected via a multiplexer to a comparing differential transducer which consecutively compares adjoining pairs of the sensors and applies the ascertained difference to a calculating unit which in the event that the difference exceeds a predetermined value calculates a correction signal applied to a single motor drive control unit which in turn supplies the correctional signal via a second multiplexer to the particular key setting drive to compensate for the deviation of the incorrectly adjusted key. The adjusting cycle is controlled by an ink flow or overall operation control unit which is manually actuated by a releasing circuit and which controls the consecutive actuation of the first multiplexer in response to the output of the differential transducer and synchronizes the cooperation between the two multiplexers and the single motor drive control unit.

For adjusting the positions of the first and of the last setting key in the marginal areas of the inking zone, it is assumed that the setting control units for these keys are adjoined by imaginary setting units adjusted to a zero position so that the amounts of inflow in the marginal areas of the zone be reduced thus affecting the printing operation.

The adjustment of the position of the first and the last active setting control units in the series of setting keys is accomplished in the aforedescribed manner while the setting units pertaining to the extreme setting keys are excluded from the adjusting process.

SUMMARY OF THE INVENTION

It is an object of this invention to provide a control system for ink zones of the above-described type which during a single adjusting cycle perform the adjustment of positions of setting keys to compensate for misalignment in the positions of the latter relative to a continuous function of the bending line of the ink blade in such a manner that even the setting units pertaining to the extreme setting keys in the marginal areas of the inking zone participate in the adjusting process.

Another object of this invention is to improve the ink zone control system by means of a device which is relatively simple in structure and requires a small number of component parts.

In keeping with these objects and others which will become apparent hereafter, one feature of the invention resides in the control system according to U.S. Pat. application Ser. No. 252,126, in the provision of an additional adjusting device which comprises a switching unit connected between the first multiplexer and the key position sensors to apply actual measured values from the sensors via the first multiplexer to the comparing differential transducer and to the calculating unit, the switching unit including additional contacts assigned to imaginary position sensors adjoining the extreme actual position sensors, a pair of sample and hold members each having an input connected to the extreme actual position sensors and an output connected to the additional contacts of the switching unit, and an auxiliary ink flow control unit triggered by the release circuit for activating at the beginning of an adjusting cycle the hold and sample members and the switching unit.

The auxiliary ink flow control unit includes a memory storing position value assigned to the imaginary position sensors and having its output connected via an encoder to the switching unit and via series connected OR-gate and AND-gate to monostable multivibrators whereby one of the multivibrators is connected to the sample and hold members and the other multivibrator is connected to the main ink flow control unit, and one of the inputs of the AND-gate being connected to the release circuit.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
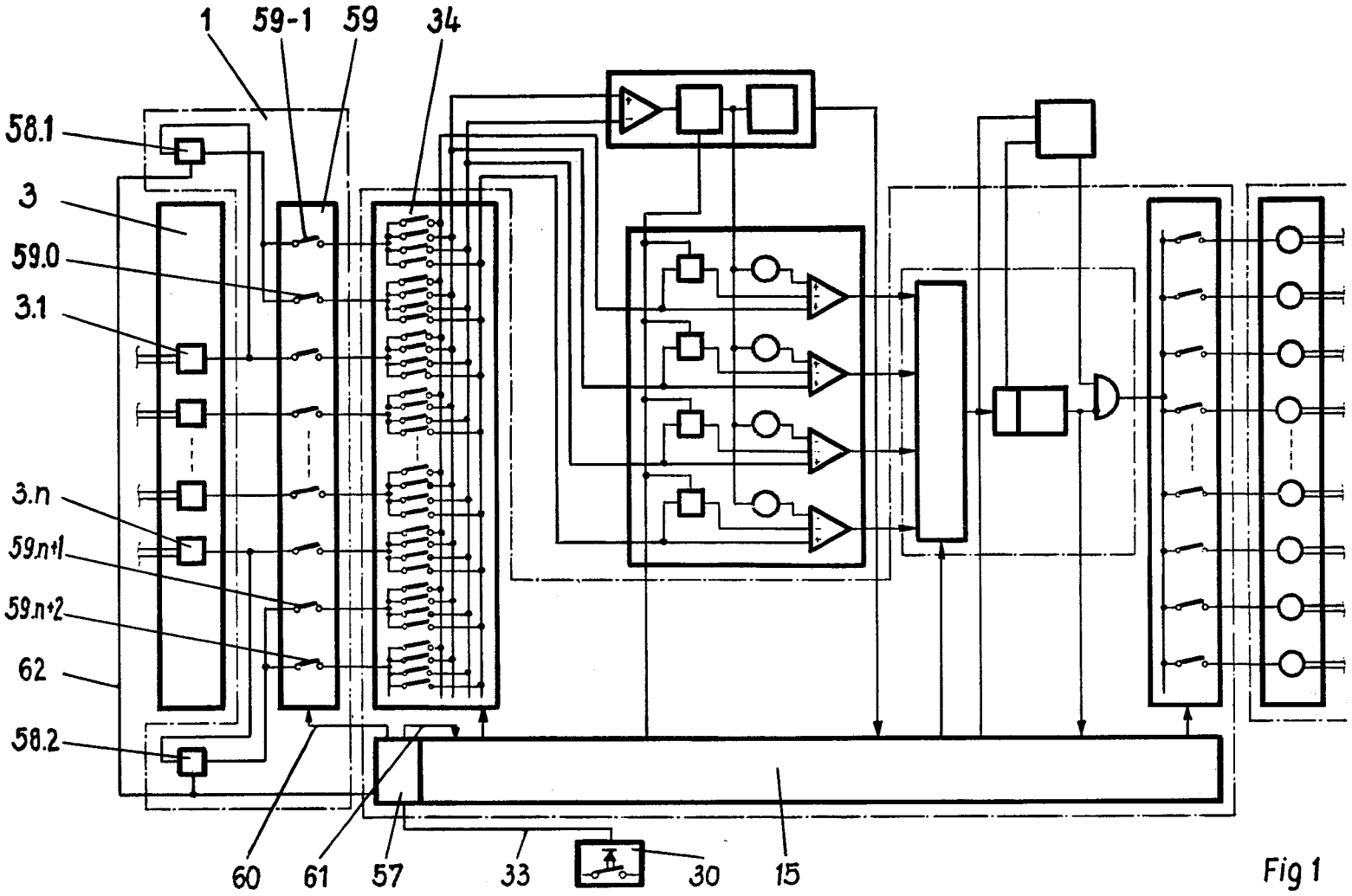
FIG. 1 is a block diagram of the control system for an ink zone according to U.S. Pat. application Ser. No. 252,126, equipped with the additional adjusting device according to this invention.

Referring firstly to FIG. 1, the control system for adjusting a continuous ink blade, as disclosed in the above-referenced application, is assembled of the key position sensing unit 3 containing a series of position sensors assigned to respective setting keys for the ink blade. A first multiplexer 34 with the plurality of switching contacts for receiving the measured position values from respective sensors 3.1 to 3.n, the main ink flow control unit 15, releasing unit 30, a comparing differential transducer 8, a computing unit 36, a setting drive control unit 40 cooperating with a pulse generator 26, and a setting drive unit 2 including a plurality of setting drives 2.1 through 2.n assigned to individual keys engaging a non-illustrated ink blade.

According to the invention, a switching unit for measured position values is connected between the actual sensors 3.1 through 3.n and the inputs of the multiplexer 34. The switching unit 59 is provided with as many switching contacts as many actual key position sensors are contained in the switching unit 3. Moreover, the switching unit 59 is also provided with additional contacts 59.0 and 59.1 adjoining the contact assigned to the first actual sensor, and additional contacts 59.n+1 and 59.n+2 adjoining the contacts in units 59 assigned to the last position sensor 3.n. As it will be explained below, these additional contacts serve for switching over position values of two extreme imaginary position sensors, one being considered as adjoining the first actual sensor and the other as adjoining the last actual sensor.

Figure 2:
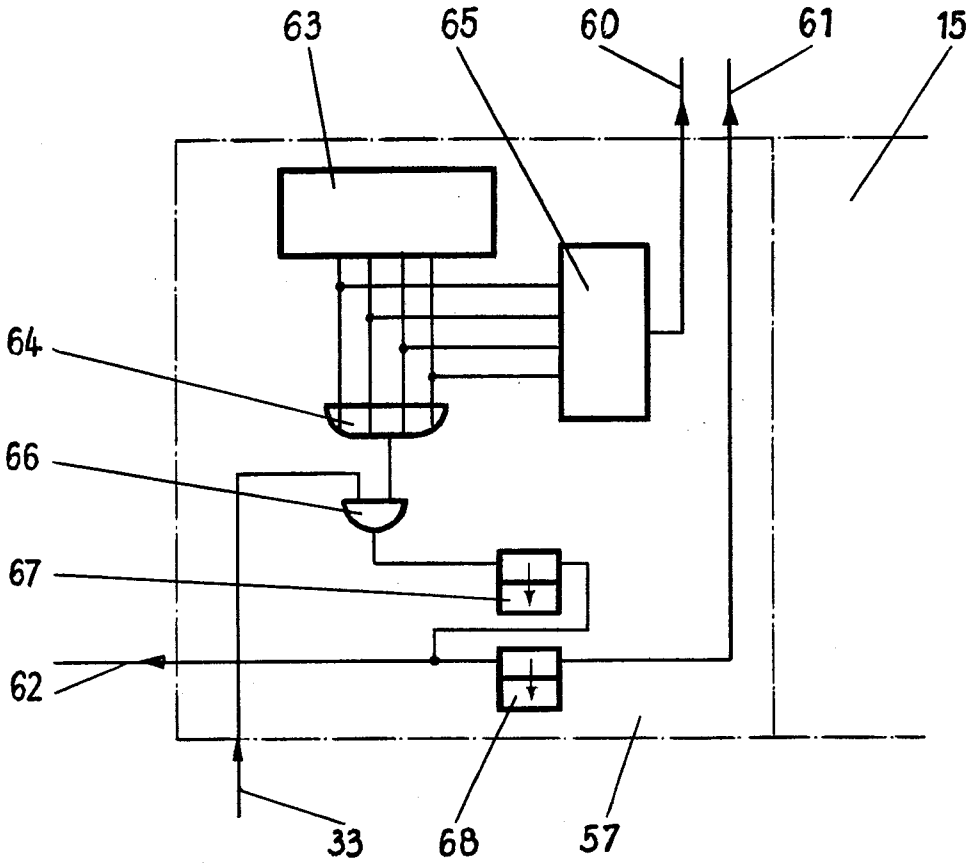
FIG. 2 is a schematic block diagram of the auxiliary ink flow control unit in the additional adjusting device of this invention.

The additional control device of this invention further includes an additional ink flow control unit 57 cooperating with the main ink flow control unit 15. As it will be seen from FIG. 2, the additional flow control unit 57 contains a memory 63 for storing the value assigned to the imaginary position sensor. The output of the memory 63 are connected to an OR-gate 64 and to an encoder 65. The output of the encoder 65 is connected via conductor 60 to the control input of the switching unit 59. The output of the OR-gate 64 is connected to one input of an AND-gate 66; the other input of AND-gate 66 is connected via conductor 33 to the release circuit 30. The output of AND-gate 66 is connected to a monostable multivibrator 67 the output of which is connected to the input of another monostable multivibrator 68 and via conduit 62 to first inputs of sample-and-hold members 58.1 and 58.2. The output of the other multivibrator 68 is connected via conduit 61 to the main ink flow control unit 15. The other input of the sample-and-hold member 58.1 is connected to the output of the first key position sensor 3.1 in the last marginal area of the inking zone. The second input of the sample-and-hold member 58.2 is connected to the output of the last key position sensor 3.n assigned to the right marginal area of the zone. The output of the sample-and-hold member 58.1 is connected to the first pair of additional contacts 59.0 and 59.1 of the switching unit 59 whereas the output of the other sample-and-hold member 58.2 is connected to the second pair of marginal contacts 59.n+1 and 59.n+2 of the unit 59.

Similarly as in the switching unit 59, the input of first multiplexer 34 is provided with additional extreme sets of switching contacts connected to the additional extreme contacts in the unit 59. The aforementioned component part of the additional adjusting device according to this invention can be readily installed in the overall control system as disclosed in the U.S. application Ser. No. 252,126.

The operation of the additional adjusting device of this invention is as follows:

By means of the control system described in the referenced patent application, the adjustment of discontinuity in the alignment of positions of individual setting keys engaging the ink blade occurs after the position of a misaligned key exceeds a predetermined limit value. The purpose of this readjustment is to prevent excessive position differences between the consecutive setting keys so as to prevent disengagement of the ink blade from the adjusting keys.

As it has been already disclosed in the main application the adjustment, according to a first mode of operation, is effected by means of data stored in a memory 63 so that all setting units participate in the adjusting process, or according to another mode of operation, the extreme adjusting units are excluded from the adjusting process. In the latter case, the switching units for measured position values 59 is activated by memory 63 via encoder 65 and conduit 60 so that the contacts assigned to setting drive elements which are excluded from the adjusting process, are set to zero.

At the same time, a signal is derived from the memory 63 which is applied via OR-gate 64 to one input of the AND-gate 66. Upon releasing a starting signal by the releasing circuit 30, this starting signal is applied via conduit 33 to the other input of AND-gate 66 and the first monostable multivibrator 67 is activated. The output of the multivibrator 67 enables via conduit 62 two sample-and-hold members 58.1 and 58.2. As a result, the measured values from the extreme setting position sensors 3.1 and 3.n is applied via the assigned sample-and-hold member to the extreme additional switching contacts in switching unit 59, thus acting as measured values derived from the imaginary marginal setting sensors. In this manner, the position of three setting keys at each end of the ink zone is equalized.

The first monostable multivibrator 67 also activates the second multivibrator 68 which in turn activates the main ink flow controlling unit 15. At this point, the adjustment of the ink blade continues in the manner as described in the main application which means the adjusting cycle starts at one of the two extreme setting control units and continues sequentially through the intermediate control units up to the opposite extreme control unit. In doing so, there are always compared measured values of two adjoining setting units and a difference signal is formed in the differential transducer and compared with a preset limit value. If this limit value is not exceeded by the differential signal, then the flow control unit addresses the next two adjoining setting units and the detected signals are again compared in the differential transducer 8, then again tested in comparison with the limit value and so on. If the limit value is exceeded, then the sensors at both sides of the incorrectly adjusted key are read and the measured values are applied to the calculating unit where a correction value for compensating the discontinuous key is computed and applied to the corresponding setting drive.

In the first-mentioned adjusting mode where all setting control units participate in the adjusting process, the first and the last setting unit due to the fact that the additional values considered generated by the imaginary extreme setting units, are applied to the switching unit, no difference signal exceeding the predetermined value can occur so that the first and the last actual setting units maintain their positions and consequently no reduction of the ink flow rate in the marginal regions of the ink zone can take place.

In the second mode of adjusting operation in which the marginal position setting units are excluded from the adjusting process and their position sensors deliver a zero measured value, the difference signal exceeds the predetermined limit value and the position of the first and the last active setting unit is reduced. Even in this manner, the extreme setting units even if excluded from the adjusting process, set the blade to ink flow rate corresponding to optimum printing operation.

It will be understood that each of the elements described above, or two or more together, may also find a useful application in other types of constructions differing from the types described above.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of the present invention.

What is claimed as new and desired to be protected by Letters Patent is set forth in the appended claims:

1. In a control system for adjusting an ink zone in a printing machine, including a continuous ink blade, a series of setting keys engaging the blade, a key setting unit including a plurality of setting drives and a plurality of key position sensors assigned respectively to the keys, a first multiplexer for sequentially switching over the position values measured by the position sensors, a second multiplexer for selectively activating said setting drives, a single drive control unit connected to said second multiplexer, a comparing differential transducer for comparing during an adjusting cycle, consecutive pairs of values measured by the position sensors, a calculating unit for calculating correction values when the output from the differential transducer exhibits a predetermined limit value, a main ink flow control unit connected to said first and second multiplexers, to said calculating unit, and to said drive control unit, and an additional adjusting device comprising a switching unit arranged between said first multiplexer and said key position sensors to apply actual measured value from said sensors via said first multiplexer to the comparing differential transducer and to the calculating unit, said switching unit including additional contacts assigned to imaginary position sensors adjoining the position sensors, a 23 pair of sample-and-hold members each having an input connected to said position sensors, and an output connected to said additional contacts of the switching unit, and an auxiliary ink flow control unit triggered by a release circuit for activating at the beginning of an adjusting cycle said sample-and-hold members and said switching unit.

2. In a control system as defined in claim 1, said auxiliary ink flow control unit in said additional adjusting device comprising a memory for storing control signals for said switching unit, an encoder having inputs connected to said memory and an output connected to said switching unit, an OR-gate having inputs connected to said memory and an output connected to an input of an AND-gate, the other input of said AND-gate being connected to said release circuit, a first monostable multivibrator activated by the output from said AND-gate and having an output connected to said sample-and-hold members to enable the latter when release signal is applied to the AND-gate, and a second monostable multivibrator having an input connected to the output of the first-mentioned multivibrator, and an output connected to an input stage of the main flow control unit.

* * * * *